US006384010B1

(12) United States Patent
Wagers

(10) Patent No.: US 6,384,010 B1
(45) Date of Patent: May 7, 2002

(54) ALL PURPOSE CLEANER WITH LOW ORGANIC SOLVENT CONTENT

(75) Inventor: Kevin J. Wagers, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/594,878

(22) Filed: Jun. 15, 2000

(51) Int. Cl.[7] ..... C11D 1/825; C11D 1/72; C11D 3/22

(52) U.S. Cl. ..... 510/470; 510/356; 510/421; 510/289

(58) Field of Search ..... 510/356, 421, 510/470, 289

(56) References Cited

U.S. PATENT DOCUMENTS

| | | | | |
|---|---|---|---|---|
| 2,560,839 A | | 7/1951 | Ayo et al. | |
| 3,223,138 A | | 12/1965 | Brown | |
| 3,234,138 A | | 2/1966 | Carroll et al. | |
| 3,350,319 A | | 10/1967 | Schonfeldt et al. | |
| 3,679,608 A | | 7/1972 | Aubert et al. | |
| 3,882,038 A | | 5/1975 | Clayton et al. | |
| 3,935,130 A | | 1/1976 | Hirano et al. | |
| 4,147,652 A | | 4/1979 | Kaniecki | |
| 4,233,174 A | | 11/1980 | Sheridan | |
| 4,244,840 A | | 1/1981 | Straw | |
| 4,315,828 A | | 2/1982 | Church | |
| 4,483,779 A | * | 11/1984 | Llenado et al. | 252/135 |
| 4,488,981 A | | 12/1984 | Urfer et al. | |
| 4,627,931 A | | 12/1986 | Malik | |
| 4,780,234 A | | 10/1988 | Malik et al. | |
| 4,921,629 A | | 5/1990 | Malihi et al. | |
| 5,008,030 A | | 4/1991 | Cook et al. | |
| 5,154,850 A | | 10/1992 | Deguchi et al. | |
| 5,236,612 A | | 8/1993 | Rahman et al. | |
| 5,244,593 A | | 9/1993 | Roselle et al. | |
| 5,370,816 A | | 12/1994 | Balzer et al. | |
| 5,474,713 A | | 12/1995 | Faber | |
| 5,501,816 A | | 3/1996 | Burke et al. | |
| 5,525,256 A | | 6/1996 | Morris et al. | |
| 5,536,452 A | | 7/1996 | Black | |
| 5,591,376 A | | 1/1997 | Kiewert et al. | |
| 5,604,195 A | * | 2/1997 | Misselyn et al. | 510/400 |
| 5,750,489 A | | 5/1998 | Garcia et al. | |
| 5,753,606 A | | 5/1998 | Hees et al. | |
| 5,767,051 A | * | 6/1998 | Drapier et al. | 510/235 |
| 5,770,549 A | | 6/1998 | Gross | |
| 5,780,417 A | | 7/1998 | Gorlin | |
| 5,798,329 A | * | 8/1998 | Taylor | 510/384 |
| 5,837,065 A | | 11/1998 | Haley et al. | |
| 5,891,836 A | | 4/1999 | Kacher | |
| 5,910,474 A | | 6/1999 | Black | |

FOREIGN PATENT DOCUMENTS

| | | |
|---|---|---|
| EP | 0 490 040 B1 | 9/1991 |
| EP | 0 953 631 | 4/1999 |
| GB | 2 185 992 | 8/1987 |
| WO | WO 98/33876 | 2/1998 |
| WO | WO 99/19439 | 10/1998 |
| WO | WO 99/19440 | 10/1998 |

* cited by examiner

*Primary Examiner*—Charles Boyer

(57) ABSTRACT

An all purpose cleaner for hard surfaces comprises an aqueous solution of a secondary alcohol ethoxylate surfactant, an alkylpolyglycoside surfactant, and water, optionally comprising a chelating agent and sufficient pH modification agent to provide an alkaline solution. The ethoxylate surfactants preferably have HLB values of from 12.2 to 14.6, and each surfactant may comprise up to about 5 weight percent of the solution. The solution may be essentially free of organic solvents, such as alkylene glycol or alkylene glycol ethers, or other volatile organic compounds. As a result, the solution may be fragrance free, and, if so desired, colorless. Optionally, however, the cleaning solution may contain fragrances, coloring agents, antibacterials, stabilizers, preservatives, and other constituents, including a minor amount of a co-surfactant.

20 Claims, No Drawings

ALL PURPOSE CLEANER WITH LOW ORGANIC SOLVENT CONTENT

CROSS REFERENCES TO RELATED APPLICATION

Not applicable.

STATEMENT REGARDING FEDERALLY SPONSORED RESEARCH

Not applicable.

BACKGROUND OF THE INVENTION

1. Technical Field

The present invention relates to hard surface cleaning compositions having low concentrations of organic solvent chemicals, or volatile organic compounds, frequently referred to as VOCs. The cleaning compositions of this invention deliver a high level of cleaning performance without reliance upon significant amounts of glycol ether solvents generally included in all purpose cleaner formulations. The use of a specific surfactant as the primary cleaning ingredient permits the exclusion or limitation of solvent, resulting in a significantly lower level of solvent odor, permitting the use of significantly less fragrancing.

2. Background Art

It is known that all purpose liquid cleaning compositions are widely accepted for cleaning hard surfaces, such as tile, wash bowls, toilets, bathtubs, walls, floors, painted and washable wall papered surfaces, etc. These all purpose cleaners generally comprise aqueous mixtures of water soluble organic detergents and water soluble detergent builder salts. Many previous such compositions relied upon the use of water soluble inorganic phosphate salts, which have now been replaced, for environmental reasons. For example, early phosphate containing compositions are set forth in U.S. Pat. Nos. 2,560,839; 3,234,138; and 3,350,319.

In light of harmful effects upon ground water caused by phosphates in cleaning compositions, improved liquid cleaners, as well as laundry detergents, containing reduced concentrations of phosphate builder salts have been developed, such as disclosed in U.S. Pat. No. 4,244,840. However, such all purpose cleaners containing detergent builder salts or other equivalents tend to leave films, spots, or streaks upon poorly rinsed cleaned surfaces, particularly noticeable on shiny surfaces for which these cleaners are most often used. Accordingly, such cleaners require thorough rinsing of the surfaces to which they are applied, a time consuming and annoying requirement, often neglected in use.

Alkyl glycoside materials such as, for example, higher alkyl monoglycosides and higher alkyl polyglycosides are known to function as nonionic surfactants, and have been suggested as being suitable for use in some detergent compositions, such as in U.S. Pat. No. 4,627,931. This reference teaches the use of nonionic glycoside surfactants in a hard surface liquid cleaning composition which comprises a nonionic surfactant component containing at least about 75 weight percent nonionic glycoside surfactant, a water miscible organic solvent, a water soluble detergent builder, and water. Examples of nonionic surfactants suitable for use with the glycosides include polyethylene oxide condensates of alkyl phenols, and condensation products of aliphatic alcohols. This reference, moreover, requires the presence of organic solvents, such as alkylene glycols and/or ethers thereof, and detergent builders such as alkali metal, ammonium or substituted ammonium polyphosphates, polyphosphonates, carbonates, polycarboxylates, carboxylated carbohydrates, etc.

In addition, all purpose cleaners have been developed employing anionic and nonionic detergents in combination with glycol ether solvent and organic amines, such as taught in U.S. Pat. No. 3,935,130. Such glycol ether solvents and organic amines are effective as grease removal solvents, and are especially helpful against oily and greasy soils. However, in addition to the need for thorough rinsing necessitated by the presence of high levels of organic detergents, such cleaners frequently also require high amounts of fragrancing to overcome the odors of the solvent materials present. Further, such solvents, frequently referred to as volatile organic compounds or VOCs, are in themselves objectionable, particularly in an age of increasing environmental awareness and concern.

Accordingly, there is a need for all purpose cleaners comprising a clear, aqueous solution having good interfacial tension for cleaning hard surfaces and good grease removal capability as a result thereof, without the presence of such objectionable components as phosphates or VOCs.

SUMMARY OF THE INVENTION

The present invention provides an improved all purpose cleaner, comprising a clear aqueous solution having acceptable interfacial tension properties, permitting good removal of greasy soil from hard surfaces such as plastic, ceramic, vitreous and metal surfaces, particularly those having a shiny finish, such as tiles, wash bowls, toilets, bathtubs, walls, floors, painted and washable wall papered surfaces, etc. The improved cleaner composition exhibits good soil removal properties with minimal rubbing, may be used diluted or undiluted, dries relatively quickly after wiping, and leaves the cleaned surface free of streaks or visible residue without rinsing. The cleaning solution is suitable for a wide range of possible uses, including (in diluted form) as a glass cleaner.

Moreover, the present cleaning composition achieves these results without the use of objectionable polyphosphate or other inorganic or organic detergent builder salts, and essentially or completely in the absence of grease removal solvents or VOCs.

Accordingly, the present composition is capable of being formulated without the addition of fragrancing agents to overcome the objectionable odors of organic solvents, and may thus be odor-free, or nearly so. As such, the present composition provides a capable all purpose liquid cleaner which may be applied by spraying upon a surface and wiping away, which is both effective as a cleansing means and environmentally acceptable.

The objects of the present invention therefore include providing an all purpose liquid cleaning composition which is environmentally acceptable, has little or no perceptible odor, and is effective in removal of grease and oil from hard surfaces. It is yet another object of the invention to provide a hard surface cleaning composition which may be sprayed upon the surface and removed by wiping, which will dry without streaking or visible residue, and requires no rinsing.

These and other objects are accomplished by provision of a cleaning composition comprising a secondary alcohol ethoxylate nonionic surfactant, an alkylpolysglycoside nonionic surfactant, and having an alkaline pH. More specifically, the all purpose cleaner of the present invention comprises from about 0.05 to about 5.0 weight percent of alkyloxypolyethylene oxyethanol, from about 0.075 to about 5.0 weight percent $C_8$–$C_{16}$ alkylpolyglycoside, and sufficient pH adjustment composition, if needed, to achieve a pH between 7.0 and 12.5, and preferably between 11.8 and 12.4. Additional components may include a chelating agent to prevent precipitation of hard water salts from materials present in the composition when hard water is employed, and optionally, coloring agents, fragrancing agents, antibacterial additives, drying agents, thickeners, and co-surfactants to boost the effectiveness of the primary surfactant. The entire composition is in the form of a water solution, preferably using soft water as the carrier, and may be provided in concentrated form for dilution prior to use by the consumer.

DETAILED DESCRIPTION OF THE INVENTION

The all purpose cleaning composition of the present invention comprises an essentially clear aqueous composition comprising a secondary alcohol ethoxylate nonionic surfactant, an alkylpolyglycoside nonionic surfactant, and, optionally a pH modifying agent and a chelating agent. The primary cleaning agent, the ethoxylate surfactant, is preferably present in a range of from about 0.25 to about 2.50 weight percent, while the alkylpolyglycoside, which assists in surface wetting and film forming, is preferably present in a range of from 0.10 to about 1.50 weight percent. There does not appear to be a critical relationship between the two surfactant components, either in terms of ratio or sum, as long as both are present. In preferred embodiments, accordingly, the sum of the two surfactant components may range from about 0.125 to about 10 weight percent of the total solution. Unless otherwise indicated, all percentages expressed herein are weight percentages based upon the weight of active ingredients.

The primary nonionic surfactants suitable for the present invention comprise water soluble alcohol ethylene oxide condensates of a secondary aliphatic alcohol containing from 9 to 18 carbon atoms in a straight or branched configuration, condensed with from 5 to 30 moles, preferably from about 7 to 12 moles, of ethylene oxide. Examples of preferred commercially available surfactants of this composition are $C_{11}$–$C_{15}$ secondary alkanols condensed with 7,9, or 12 moles of ethylene oxide, available from Union Carbide under the tradenames Tergitol® 15-S-7, 15-S-9, and 15-S-12, for example, believed to comprise alkyloxypolyethylene oxyethanol. Additional suitable surfactants, of the same type, are marketed by Union Carbide under the tradenames Tergitol® TMN-6 and TMN-10, believed to comprise reaction products of trimethyl-nonanol with ethylene oxide.

A key property held in common by these compositions is an HLB value greater than 11.5 but less than 15.0. The term HLB value refers to hydrophobic lipophilic balance value, a measure of water solubility and ability to give good emulsification, critical properties for a detergent composition. In general, compositions with an HLB value of less than about 10 tend to be poorly soluble in water.

A single member of this group of surfactant compositions may be employed, or mixtures of such suitable surfactant materials may be employed, provided that the average HLB values of the surfactant or the mixture of surfactants is from about 11.5 about 15.0, preferably from about 12.2 to about 14.6, and most preferably from about 12.4 to about 14.4.

The quantity of secondary alcohol ethoxylate employed may range from as low as about 0.05 weight percent of the composition, an amount suitable for use in a ready-to-use glass cleaning composition, up to concentrations at which streaking and solubility issues arise. Generally, up to about 5 percent by weight of the composition may comprise a secondary alcohol ethoxylate surfactant, above which amount streaking becomes a factor. A preferred range for the ethoxylate surfactants is from about 0.25 to about 2.5 weight percent, with a range of from about 0.5 to about 1.5 weight percent being more preferred.

In addition to the secondary alcohol ethoxylate surfactants, the present cleaning compositions comprise an alkylpolyglycoside surfactant. Glycoside surfactants suitable for use in the present invention may be selected from those of the general formula $RO(R'O)_y(Z)_x$, wherein R is a monovalent organic radical, (such as an monovalent saturated aliphatic, unsaturated aliphatic, or aromatic radical such as alkyl, hydroxyalkyl, alkenyl, aryl, arylalkyl, etc.) containing from about 8 to about 18 carbon atoms; R' is a divalent hydrocarbon radical containing from 2 to 4 carbon atoms such as ethylene, propylene, or butylene; Z represents a moiety derived from a reducing saccharide containing 5 or 6 carbon atoms (preferably a glucose unit); y is a number having an average value of from 0 to about 12; and x is a number having an average value of from 1 to about 10, preferably from 1 to 3.

Most suitable among these glycoside surfactants are the alkylpolyglycosides, particularly those available from Cognis, Inc., under the tradenames APG® 325, based upon a synthetic alcohol having from 9 to 11 carbon atoms, and GLUCOPON® 425, based upon a natural alcohol having from 8 to 16 carbon atoms. The alkylpolyglycoside surfactant may be present in an amount of from about 0.075 weight percent, an amount suitable for use in a ready-to-use window composition, for example, up to about 5.0 weight percent, the upper limit being a function of solubility, streaking, and cost. Preferably, the alkylpolyglycoside is present in a range of from about 0.1 to about 1.5 weight percent, and most preferably in a concentration of about 0.5 to about 1.0 weight percent.

As previously indicated, both the alcohol ethoxy surfactant and the alkylpolyglycoside surfactants are necessarily present in the present invention. The ratio of the two does not appear to be critical to the success of the cleaning composition, and the total quantity of the two may be merely the sums of the two components used.

In addition, it has been found that the presence of a small amount of a chelating agent may be necessary to prevent precipitation of components present in the components of the cleaner if the solution utilizes hard water. Conventional chelating agents such as the tetrasodium salt of EDTA, sodium nitrilotriacetate, and sodium citrate may be employed, in a suitable concentration of from about 0.004 to about 0.4 weight percent, preferably about 0.1 percent active. Such chelating agents are appropriate to prevent the precipitation of hard water salts of materials frequently present in commercially available alkylpolyglycosides, but are unnecessary if deionized water is employed.

The pH of the solution should be above 7.0, and preferably from about 8.0 to about 12.5. The most preferred pH may range from about 11.8 to about 12.4. If necessary for pH adjustment, sodium hydroxide, or caustic, is employed in sufficient quantity to adjust the pH to the desired alkalinity. Alternatively, sulfuric acid and citric acid, or similar acidic compositions, may be employed to lower pH if appropriate. It has been found that raising the pH above about 8.0 has a beneficial effect upon the grease cleaning capability of the surfactants used in the present invention, and while lower pH may be acceptable for light duty cleaning where little or no greasy soil is present, such as with a glass cleaner, elevation of the pH to a value of from about 11.8 to about 12.4 is preferred. Above a pH of about 12.5, however, the cleaning solution becomes excessively caustic, presenting possible injuries to the skin, and damage to surfaces upon which the solution is used. Moreover, such highly caustic solutions create an unstable system, and can be damaging to processing, handling, and storage equipment.

Since the cleaning composition is an aqueous solution, the active ingredients should be mixed with water to the desired concentrations. It is desirable that soft water be used, but one may use distilled, deionized, or filtered tap water, containing no compounds reactive with the cleaning solution ingredients, and containing no materials which would leave a residue or streaking on surfaces to which the cleaning composition is applied. Since the compositions as prepared are aqueous liquid formulations, and since water comprises the major ingredient, no particular mixing is required to obtain a uniform solution, and the cleaning composition may be prepared simply by combining all of the ingredients in a suitable vessel or container. The order of mixing the ingredients is not particularly important, and generally the various ingredients may be added sequentially or all at once, or in the form of aqueous solutions of each, or all of the ingredients may be separately prepared and combined with each other. The pH adjustment should be made last, however, after all other ingredients have been mixed and a stable solution formed.

While the above combination of a secondary alcohol ethoxylate surfactant, an alkylpolyglycoside surfactant, and water, comprises a preferred embodiment of the all purpose cleaner of the present invention, other optional modifications and additions may be made. Another preferred embodiment of the invention comprises the above combination plus a chelating agent and a pH modifier to bring the solution to a pH of from about 11.8 to about 12.4. Further, fragrances may be present in the cleaning solution, although the avoidance of glycol ethers and other VOCs commonly employed in all purpose cleaning solutions greatly lowers the necessity or desirability for the addition of a perfume. Fragrances suitable for use in the present invention include all suitable perfumes or essential oils, selected, for example and without limitation, from the group consisting of Aniseed oil, Balsam, Basil, Camphor, cinnamon, Citronella, Clove, Coriander, Coumarin, Eucalyptus, Fennel, Ginger, Grapefruit, Juniper berry, Lemon, Lemongrass oil, Musk ketone, Nutmeg, Orange, Patchouli, Peppermint, Sage, Sassafras, Spearmint, Lavender, Wintergreen, Geraniol, and the like.

Optionally, other ingredients which are compatible with the water soluble surfactants may be included, such as up to about 5 weight percent of a thickening if agent such as hydroxyethyl cellulose, xanthan gum, or other conventional thickening and agents. Particulate additives such as silica and other high surface area particles are to be avoided in accordance with the purpose of the present invention, which is to provide a non streaking cleaning solution. Similarly, other conventional additives such as dyes, preservatives, disinfectants, and buffering agents, may be included in the aqueous solutions of the present invention provided that they are compatible with the other ingredients present.

In addition, small quantities of alkylene glycols and/or ethers thereof may also be added as co-surfactants, to boost the cleaning power of the other surfactants present. These conventional cleaning agents may be present in an amount preferably less than about 4 weight percent, but possibly in ranges from zero to about 10 weight percent, up to limits of solubility, odor, and VOC contribution to the cleaning composition of the invention. Preferred examples of such co-surfactants include, without limitation, such organic solvents as ethylene glycol monohexyl ether, butyl proposol, and butyl cellosolve, and the like.

Still further, small quantities, such as from zero to about 3 weight percent, of drying agents may be included. Suitable drying agents include such alcohols as isopropanol, ethanol, tert-butanol, and the like.

EXAMPLES

The following test method was employed to determine the relative cleaning efficacy of a composition in accordance with the present invention, relative to removal of greasy soils which could be found on kitchen hard surfaces following food preparation. A greasy soil was applied to a porcelain enameled metal tile, and allowed to rest or "cure" for at least one hour. The tile was then cleaned, using the test composition, a cellulose sponge, and a linear scrubbing machine. Comparative cleaning efficacy may be determined by counting "strokes to clean", or may be determined gravimetrically.

| Weight percent | Common name | Chemical name |
|---|---|---|
| 96.532 | Soft water | Water |
| 1.500 | Tergitol ® 15-S-7 | Alkyloxypolyethylene oxyethanol |
| 1.500 | APG ® 325 NK (50% active) | Alkylpolyglycoside |
| 0.250 | Versene ® 100 (40% active) | Tetrasodium salt of EDTA |
| 0.218 | Caustic soda (50% active) | Sodium hydroxide |

This composition was tested, and found to remove the greasy soil acceptably. Additional samples were prepared, varying both the proportion and selection of secondary alcohol ethoxylate surfactant utilized. In these samples, the following proportions of the following ethoxylates were substituted for the 1.5 percent of Tergitol® 15-S-7 used above: 0.5 percent Tergitol® 15-S-7; 0.54 percent Tergitol® TMN-6; a mixture of 0.6 percent Tergitol® 15-S-7 and 0.63 percent Tergitol® TMN-6; and a mixture of 0.5 percent Tergitol® 15-S-7, 0.45 percent Tergitol® TMN-6, and 0.25 percent Tergitol® 15-S-5. In each instance, the other ingredients were unchanged, with the exception of the water. Further, in each instance, the examples were tested, and were also found to remove greasy soil acceptably.

The all purpose cleaners as taught herein are ready for direct use upon a surface, or may be diluted as desired. In either instance, little or no rinsing is required, and substantially no visible residue or streaks remain on the cleaned surface after the cleaner is wiped away, for example with a clean damp cloth or paper toweling. Further, since the cleaners are essentially free of detergent builders such as alkali metal polyphosphates, they are environmentally acceptable, and provide a highly reflective shine on hard surfaces. Moreover, since the compositions of the present invention preferably contain no glycol ethers or VOCs, they may be prepared with no fragrances or other objectionable additives, such as coloring dyes. Accordingly, the present invention provides an effective and environmentally friendly all purpose aqueous cleaning solution which is essentially colorless and odorless.

While intended for use directly upon a hard surface, the cleaning solution of the present invention may be applied directly from the bottle, diluted with additional water and applied as a dilute cleaner, or sprayed upon the surface, as from a pump applicator or a pressurized aerosol container, for spray and wipe applications.

INDUSTRIAL APPLICABILITY

The present invention provides a cleaning solution which is an environmental improvement over cleaning solutions presently available. The solution of the present invention comprises water soluble compositions which are readily available in commercial quantities, and which may be combined and mixed in a simple manner in standard equipment to provide an aqueous cleaner which may be conventionally packaged for use in a conventional manner.

While the present invention has been described with respect to what is at present considered to be the preferred embodiments, it is to be understood that the invention is not to be limited to the disclosed embodiments. To the contrary, the invention is intended to cover various modifications and equivalent arrangements within the spirit and scope of the appended claims. The scope of the following claims is to be accorded the broadest interpretation so as to encompass all such modifications and equivalent formulations and functions.

I claim:

1. An aqueous all purpose cleaning solution comprising from about 0.05 to about 5.0 percent secondary alcohol ethoxylate surfactant, from about 0.075 to about 5.0 percent alkylpolyglycoside surfactant, from 0.01 to about 1.0 chelating agent, and water, said solution having an alkali pH.

2. The solution of claim 1, wherein said ethoxylate surfactant has an HLB value of from 12.2 to 14.6 and comprises from about 0.25 to about 2.5 percent of the solution.

3. The solution of claim 2, wherein said HLB value is from 12.4 to 14.4, and said pH has a value of from 11.8 to 12.4.

4. The solution of claim 3, wherein said alkylpolyglycoside surfactant comprises from about 0.1 to about 1.5 percent of the solution.

5. The solution of claim 4, further comprising up to about 4.0 percent of a co-surfactant organic solvent selected from the group consisting of alkylene glycols and ethers thereof.

6. The solution of claim 5, further comprising a fragrance.

7. The solution of claim 1, wherein said secondary alcohol ethoxylate surfactant has an average HLB value of from about 11.5 to about 15.0.

8. The solution of claim 7, wherein said composition has a pH of from about 8.0 to about 12.5.

9. The solution of claim 8, wherein said ethoxylate surfactant comprises a condensate of a secondary alcohol having from 9 to 18 carbon atoms with from about 7 to 12 moles of ethylene oxide.

10. The solution of claim 9, wherein said ethoxylate surfactant is alkyloxypolyethylene oxyethanol and comprises from about 0.25 to about 2.5 weight percent of the composition.

11. The solution of claim 9, wherein said alkylpolyglycoside surfactant is present in a range of from about 0.1 to about 1.5 weight percent.

12. The solution of claim 11, wherein the HLB value of said ethoxylate surfactant averages from about 12.2 to about 14.6, said ethoxylate surfactant comprises from about 0.5 to about 1.5 weight percent of the composition, and said alkylpolyglycoside surfactant comprises from about 0.5 to about 1.0 weight percent of the composition.

13. The solution of claim 9, wherein said ethoxylate surfactant is a condensate of a $C_{11}$–$C_{15}$ secondary alkanol and comprises from about 0.25 to about 2.5 weight percent of the composition.

14. The solution of claim 13, wherein said alkylpolyglycoside surfactant is present in a range of from about 0.1 to about 1.5 weight percent.

15. The solution of claim 14, wherein the HLB value of said ethoxylate surfactant averages from about 12.2 to about 14.6, said ethoxylate surfactant comprises from about 0.5 to about 1.5 weight percent of the composition, and said alkylpolyglycoside surfactant comprises from about 0.5 to about 1.0 weight percent of the composition.

16. An aqueous all purpose cleaning solution comprising from about 0.25 to about 2.50 percent secondary alcohol ethoxylate surfactant, from about 0.10 to about 1.50 percent alkylpolyglycoside, from about 0.01 to about 0.4 percent chelating agent, sufficient pH modifier to yield a pH of from about 8.0 to about 12.5, a fragrance, and water.

17. The solution of claim 16, wherein said secondary alcohol ethoxylate comprises alkyloxypolyethylene oxyethanol.

18. The solution of claim 17, wherein said secondary alcohol ethoxylate comprises about 2.0 percent of said solution.

19. The solution of claim 17, wherein said alkylpolyglycoside comprises about 1.5 percent of said solution.

20. The solution of claim 16, wherein said fragrance comprises orange oil.

* * * * *